United States Patent [19]

Chiodi et al.

[11] Patent Number: 4,794,299

[45] Date of Patent: Dec. 27, 1988

[54] FLAT TENSION MASK COLOR CRT FRONT ASSEMBLY WITH IMPROVED MASK FOR DEGROUPING ERROR COMPENSATION

[75] Inventors: Wayne R. Chiodi, Northbrook; Charles J. Prazak, III, Elmhurst, both of Ill.

[73] Assignee: Zenith Electronics Corporation, Glenview, Ill.

[21] Appl. No.: 843,890

[22] Filed: Mar. 25, 1986

[51] Int. Cl.[4] ..... H01J 29/07; H01J 29/32

[52] U.S. Cl. ..... 313/402; 313/408

[58] Field of Search ..... 313/402, 408

[56] References Cited

U.S. PATENT DOCUMENTS

| | | | |
|---|---|---|---|
| 2,755,402 | 7/1956 | Morrell | 313/70 |
| 2,947,899 | 8/1960 | Kaplan | 313/92 |
| 3,590,303 | 6/1971 | Coleclough | 313/92 |
| 3,652,895 | 3/1972 | Tsuneta et al. | 313/85 |
| 3,686,525 | 8/1972 | Naruse et al. | 313/92 |
| 3,947,718 | 3/1976 | van Lent | 313/408 |
| 4,370,591 | 1/1983 | Satoh | 313/402 |
| 4,630,212 | 1/1987 | Nakamura | 313/402 X |
| 4,636,683 | 1/1987 | Tokita et al. | 313/403 |

FOREIGN PATENT DOCUMENTS

| | | | |
|---|---|---|---|
| 23446 | 2/1982 | Japan | 313/402 |
| 157039 | 9/1983 | Japan | 313/402 |

*Primary Examiner*—David K. Moore
*Assistant Examiner*—K. Wieder

[57] ABSTRACT

A planar tension mask is disclosed for use in a color cathode ray tube having a substantially flat faceplate. The shadow mask according to the invention has an aperture pattern characterized by the vertical pitch of the apertures being constant, but with the horizontal pitch of the apetures increasing outwardly from the mask center according to a function which is parabolic with horizontal displacement, and parabolic with vertical displacement. The horizontal pitch increase is isotropic in the sense that the increase in pitch is the sum of the horizontal displacement increase and the vertical displacement increase. A color cathode ray tube front assembly having such a shadow mask is also disclosed.

16 Claims, 4 Drawing Sheets

FLAT TENSION MASK COLOR CRT FRONT ASSEMBLY WITH IMPROVED MASK FOR DEGROUPING ERROR COMPENSATION

CROSS-REFERENCE TO RELATED APPLICATION AND PATENT

This application is related to, but is in no way dependent upon, application Ser. No. 832,556 filed Feb. 21, 1986, and U.S. Pat. No. 4,547,696, of common ownership herewith.

BACKGROUND OF THE INVENTION

1. Field of the Invention

This invention concerns tension mask color cathode ray tubes, and more particularly, relates to an improved front assembly having a mask with an aperture pattern which reduces beamlet degrouping errors.

2. Definitions

As used herein, the term "screen" refers to the field of discrete phosphor deposits on the inner surface of the tube faceplate which emit red, green or blue light upon excitation by the electron beams.

As used herein, the term "shadow mask" is a component of a color cathode ray tube located in spaced adjacency to the faceplate, one having a plurality of apertures for the passage of the electron beams that excite phosphors disposed on the screen of the faceplate. The shadow mask "shadows" the triads of phosphor deposits on the faceplate so that only the proper beam falls upon the assigned ones of the phosphor deposits. The shadow mask is also eeferred to as a "color selection electrode", or "parallax barrier." The shadow mask that is the subject of this invention is a flat, or "planar" mask.

As used herein, the term "pitch" means the center-to-center distance between shadow mask apertures. The symbol "Ph" refers to the horizontal pitch, or distance, between aperture centers, and the symbol "Pv" refers to the vertical pitch between aperture centers. Pho and Pvo are, respectively, the horizontal and vertical pitch of the mask apertures at the mask center.

As used herein, the term "grade" or "graded pitch" or "graded aperture dimension" means a shadow mask in which the pitch and/or aperture dimensions vary from one area of the mask to another; e.g. from the center of the mask to its periphery.

As used herein, "electron beamlet" means the portion of an electron beam passing through a mask aperture.

As used herein, the term "degrouping" refers to a a non-symmetrical placement of the beamlets of a deflected beamlet trio as the trio intercepts the screen. Degrouping error refers to the magnitude of the degrouping-induced misregistration of the beamlets relative to the impinged phosphor deposits. As a result of degrouping, a part or all of an outer beamlet or beamlets may fail to land on the assigned phosphor deposit(s) with consequent color impurities and reduced brightness in peripheral areas of the screen.

As used herein, the term "beam landing area" is that area of the screen upon which a beamlet falls.

As used herein, the term "positive guard band" means a condition wherein the beam landing area is smaller than the phosphor element upon which it lands; as a result, the area of the phosphor element unexcited by the beam serves as a positive guard band. The term "negative guard band" means a condition in which the beam landing area is larger than the phosphor element upon which it lands by a predetermined guard band area. In negative guard band screens, the margin of safety, or guard band, that prevents color impurities is conventionally covered with a light-absorbing material.

The Causes of Beam Misregistration

One effect of beam misregistration is degrouping of the beamlets, resulting in color impurities. Beam degrouping errors can result from such factors as errors in the geometries of the substantially flat faceplate and the associated planar mask, the in-line condition of the three beams, and the influence of the self-converging yoke.

Dynamic convergence of the three beams of an in-line electron gun is provided in present-day television systems primarily by a self-converging yoke. This type of yoke is typically a hybrid having toroidal-type vertical deflection coils and saddle-type horizontal deflection coils. The yoke contains windings which produce an astigmatic field component that has the effect of maintaining the beams in convergence as they are swept across the screen. The convergence achieved is not without cost, however, as the beam spots are subject to degrouping and distortion in the peripheral areas of the screen. The degrouping effect is compensated for in conventional curved-screen tubes by adjusting the contour of the glass panel; however, when the screen and mask are flat, this is not an option. Any attempt to further modify the configuration of the self-converging yoke field to adapt it to a flat screen is apt to increase degrouping outside the limits of acceptability.

Prior Art

The following examples are being submitted to the Patent and Trademark Office for evaluation as to possible relevance to the claimed subject matter. The examples are believed to be the closest of the art of which applicant is aware, but appiicant makes no admission as to its relevance in fact, to its legal sufficiency, or to its priority in time, nor does applicant represent that no better art exists.

1. U.S. Pat. No. 3,590,303 to Coleclough. Coleclough discloses a shadow mass embodiment in which the center-to-center spacing of the apertures in both the radial and azimuthal directions is greater at the periphery of the mask than at the center thereof, and the center-to-center spacing of the associated phosphor dots in both the radial and tangential directions is likewise greater at the periphery of the screen than at the center. Also, there is disclosed an embodiment in which the phosphor dots increase in size from the center of the screen and are substantially tangential to one another throughout the screen.

2. U.S. Pat. No. 3,686,525 to Naruse et al. There is disclosed a shadow mask having apertures aligned along barrel-shaped lines extending in a horizontal direction, and along pin-cushioned lines extending in a vertical direction. The apertures are sized such that the distribution of the electronbeam transmission factor of the mask is graded concentrically about the center of the mask.

3. U.S. Pat. No. 3,370,591 to Satoh. Satoh discloses a circular-aperture shadow mask for a color picture tube having an in-line gun in which the horizontal arrangement of the apertures is such as to make the distance between adjacent beam landing areas substantially equal. This equality is accomplished by tilting the angle of the apertures to correspond to the angle (with respect to the x-axis) of the associated electron beams.

4. U.S. Pat. No. 3,652,895 to Tsuneta et al. Tsuneta et al discloses a shadow mask having rectangular electron-beam-passing apertures (a "slot mask") graduated both vertically and horizontally in size and pitch from the center of the mask to its periphery. The purpose is said to be the improvement in the coefficient of beam transmissivity for the peripheral portion of the mask so as to prevent color shading and to enhance picture brightness. The mask is considered to be a "graded" mask in that the slots are narrower and longer at the mask periphery than at its center.

5. U.S. Pat. No. 3,947,718 to van Lent. The display screen of a color CRT comprises a line pattern of elongated phosphor regions. The apertures in the shadow mask, also elongated, have the shape of an approximately spherical sector, and are arranged along curved lines. During manufacture, apertures are aligned in one flat plane, with the central axis of a linear light source located in the deflection region. The invention is said to provide linear luminescent regions with substantially straight edges, instead of "undulating" edges.

6. U.S. Pat. No. 2,947,899 to Kaplan. A compensated aperture mask structure is disclosed having a plurality of apertures which are round at the axial aperture, but distorted into an elliptical configuration by radial foreshortening as a function of the distance of the apertures from the axial aperture. The stated purpose is to rectify degrouping errors.

7. U.S. Pat. No. 2,755,402 to Morrell. A shadow mask contains a multiplicity of "dot-like" aperture elements arranged in a pattern which is systematically related to a pattern of dot-like elements on an adjacent screen. The dot-like elements comprising one of the patterns are of substantially uniform diameter, add the dot-like elements comprising the other pattern diminish in diameter outwardly from a region of maximum diameter near it center.

Other prior art: U.S. Pat. No. 3,435,268 to Rublack et al.

SHORTCOMINGS OF THE PRIOR ART

The disclosures are directed primarily to CRT front assemblies in which the faceplate is curved, and the associated shadow mask is correlatively curved. The disclosures and their solutions are deemed to be inapplicable to compensating for degrouping errors which can occur in a color cathode ray tube having an in-line electron gun and a self-corverging yoke, and a front assembly comprising a substantially flat faceplate and an associated planar shadow mask in spaced adjacency thereto.

OBJECTS OF THE INVENTION

It is an object of the invention to provide a flat tension mask color cathode ray tube having improved resolution, image brightness, and color purity.

It is another object of the invention to provide, in such a tube, a front assembly with an improved shadow mask aperture pattern which reduces degrouping errors occurring as a result of the combining of a flat mask, a substantially flat faceplate, an in-line electron gun, and a self-converging yoke.

It is yet another object of the invention to provide a front assembly for color cathode ray tube having a an in-line electron gun and a self-converging yoke, and a rront assembly comprising a substantially flat faceplate and an associated planar shadow mask in spaced adjacency thereto, and wherein the shadow mask has an aperture pattern that reduces beamlet degrouping errors.

BRIEF DESCRIPTION OF THE FIGURES

The figures are views depicting our invention.

NOTE: The location of the phosphor deposits on the faceplate, and the positioning of the beamlets landing on each of the deposits, is a function of the pitch of the mask. Consequently, to depict mask aperture pitch according to the invention, it is necessary to depict the effect on the phosphor deposits on the faceplate, as is shown by FIGS. 4, 4A, 5 and 8 that follow.

Figure 4:
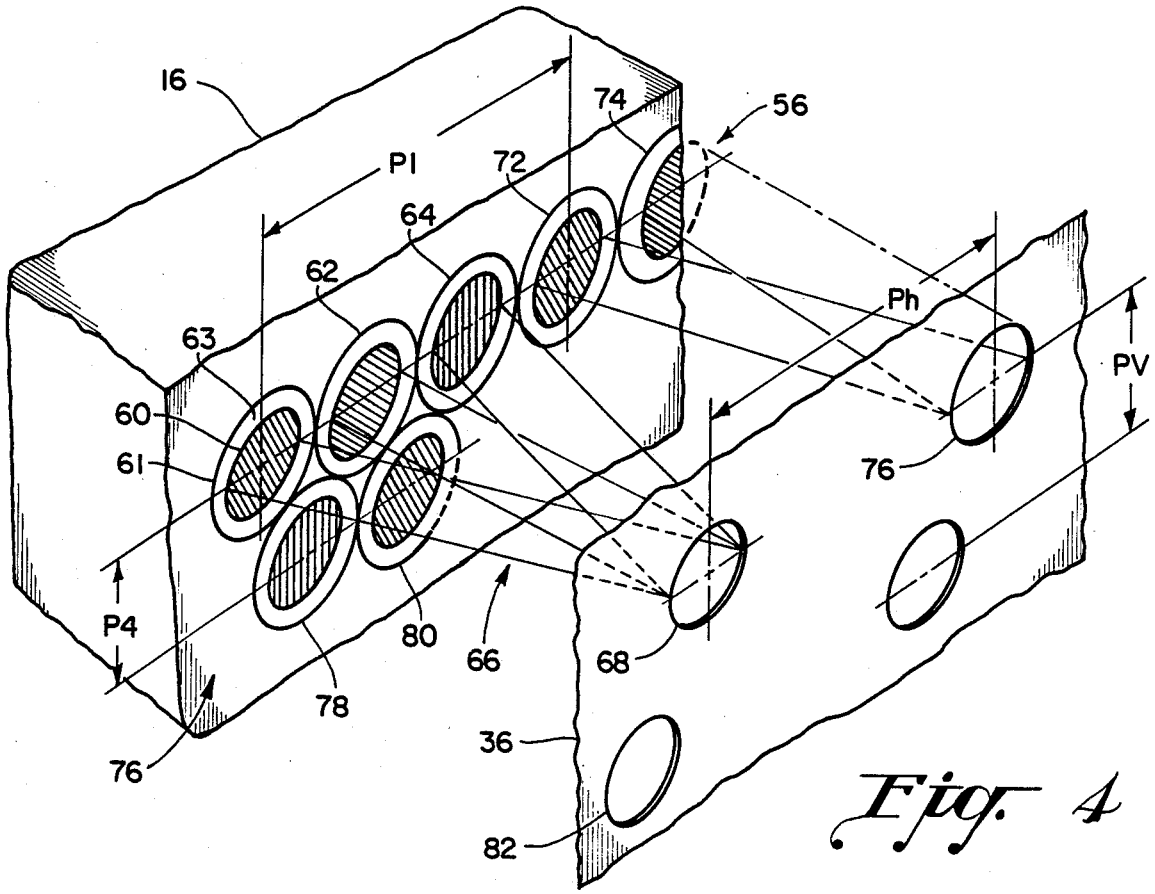
Figure 4A:
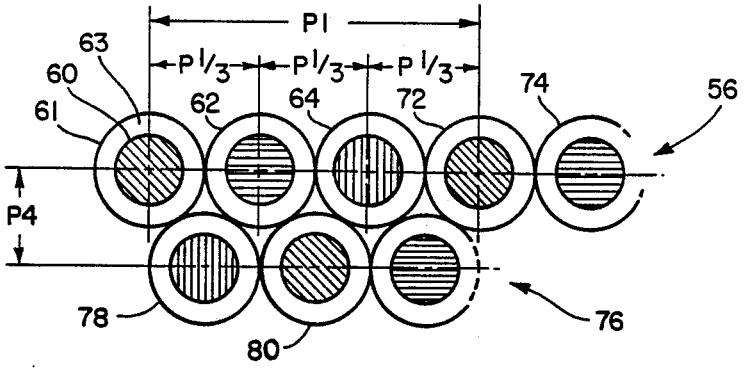
Figure 5:
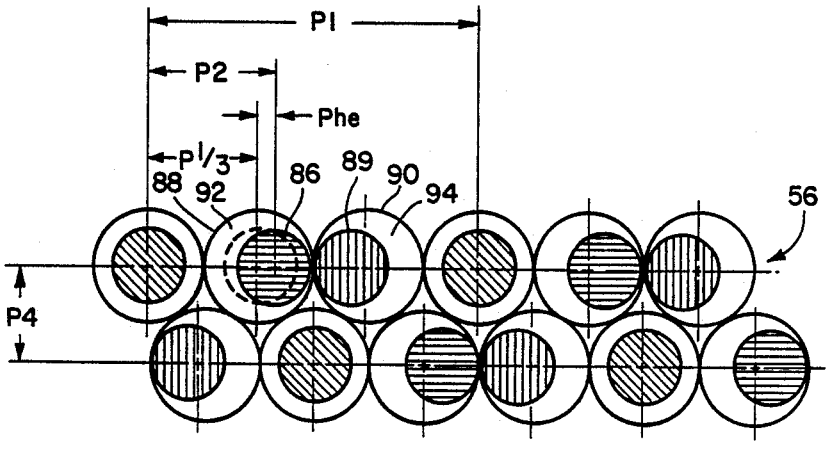
Figure 6:
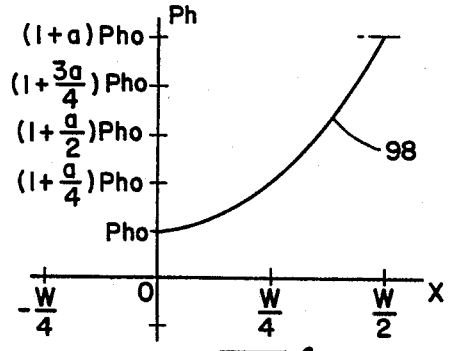

FIG. 4 is a view in perspective depicting a section of a shadow mask shown in relation to a section of a faceplate having a group of phosphors deposited thereon activated by beamlets in an ideal relationship;

FIG. 4A is plan view of the group of phosphors shown by FIG. 4;

FIG. 5 is a diagrammatic view of the effect of the degrouping of beamlets at a position away from the center of the mask that is in consequence of a combination including a a self-converging yoke and an in-line electron gun, and a front assembly comprising a substantially flat faceplate and an associated planar shadow mask in spaced adjacency thereto;

FIG. 6 is a depiction of horizontal aperture pitch of a shadow mask as a function of screen width based on the formula $$P2 - P\tfrac{1}{3} = \left(a\left(\frac{2x}{W}\right)^2 + b\left(\frac{2y}{H}\right)^2\right)Pho;$$

Figure 6A:
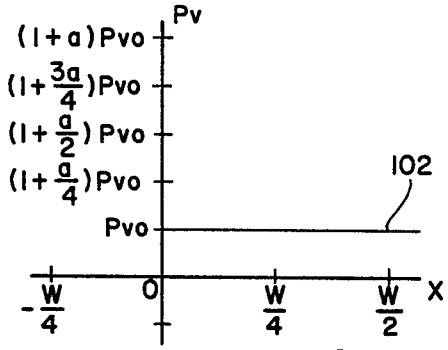
Figure 7:
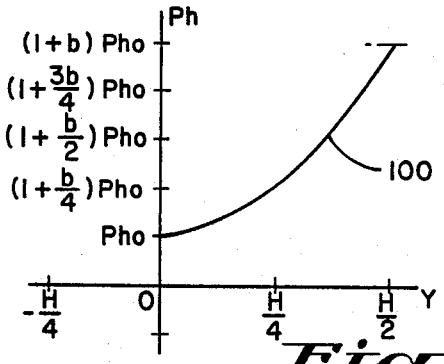
Figure 7A:
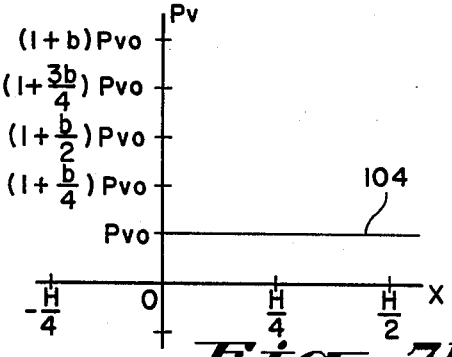
Figure 8:
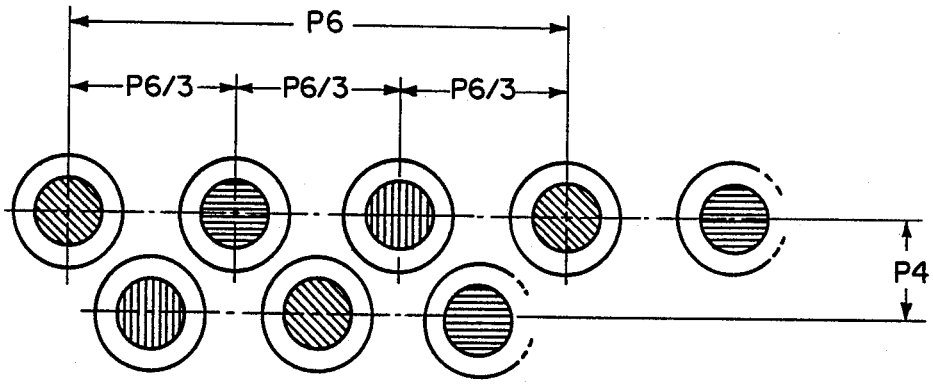
Figure 9:
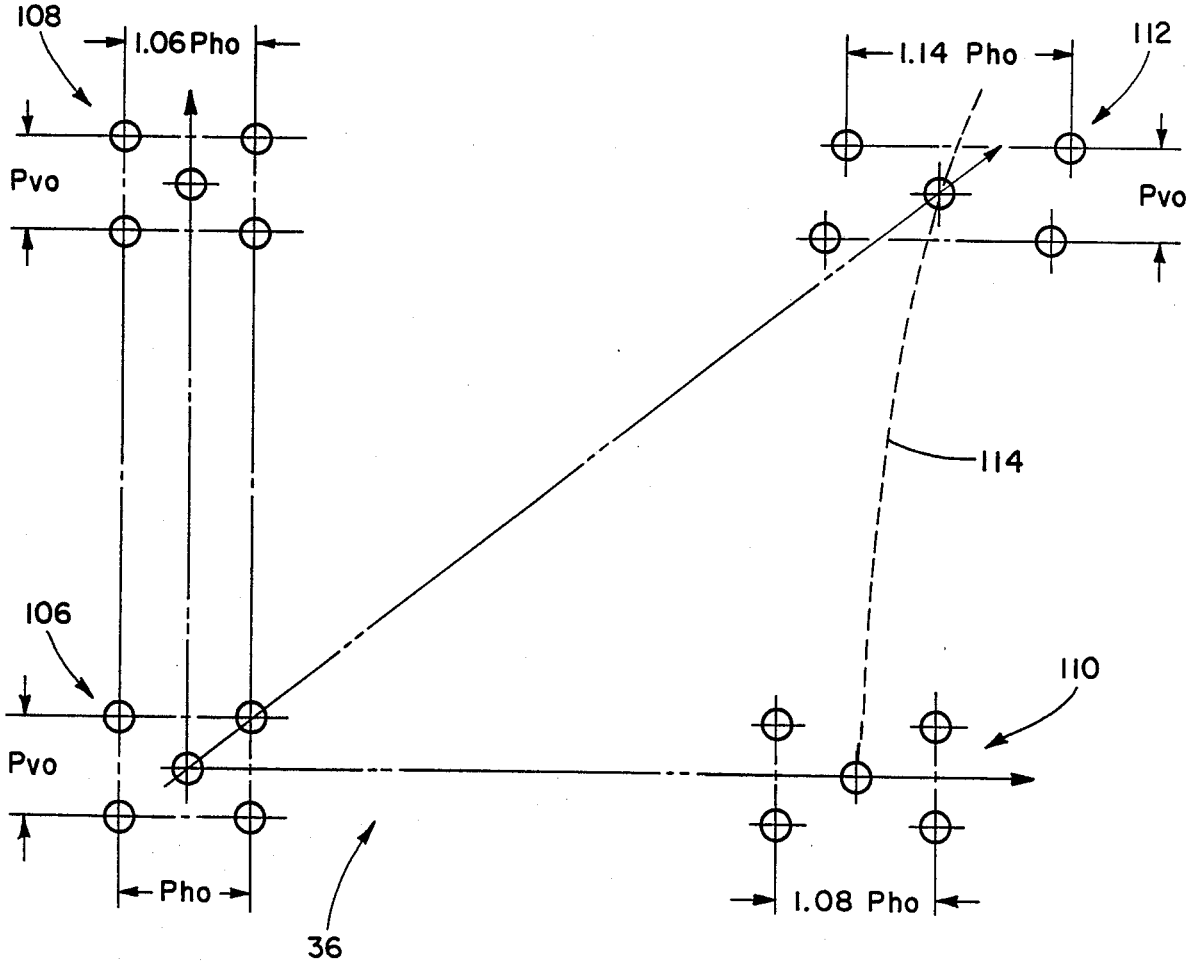

FIG. 6A is a depiction of vertical aperture pitch as a function of screen width;

FIG. 7 is a depiction of horizontal aperture pitch as a function of screen height based on the formula cited for FIG. 6, above; FIG. 7A is a depiction of vertical aperture pitch as a function of screen height;

Note: The curves of FIGS. 6 and 6A, and 7 and 7A represent the upper right quadrant of the mask according to the invention; the other quadrants (−x and −y) are substantially mirror images;

FIG. 8 is a diagrammatic view of the effect of the desired distribution of beamlets on the associated phosphor deposits according to the invention; and FIG. 9 is a diagrammatic view of the upper right quadrant of a planar shadow mask having a distribution of apertures according to the invention.

DESCRIPTION OF THE PREFERRED EMBODIMENT

This specification includes a description of the the best mode presently contemplated for carrying out the invention, and appended claims.

The components of the invention are disclosed in the drawings and are identified and described in the following paragraphs in this sequence: reference number, a reference name, and a brief description of structure, interconnections, relationship, functions, operation, and/or result, as appropriate.

Figure 1:
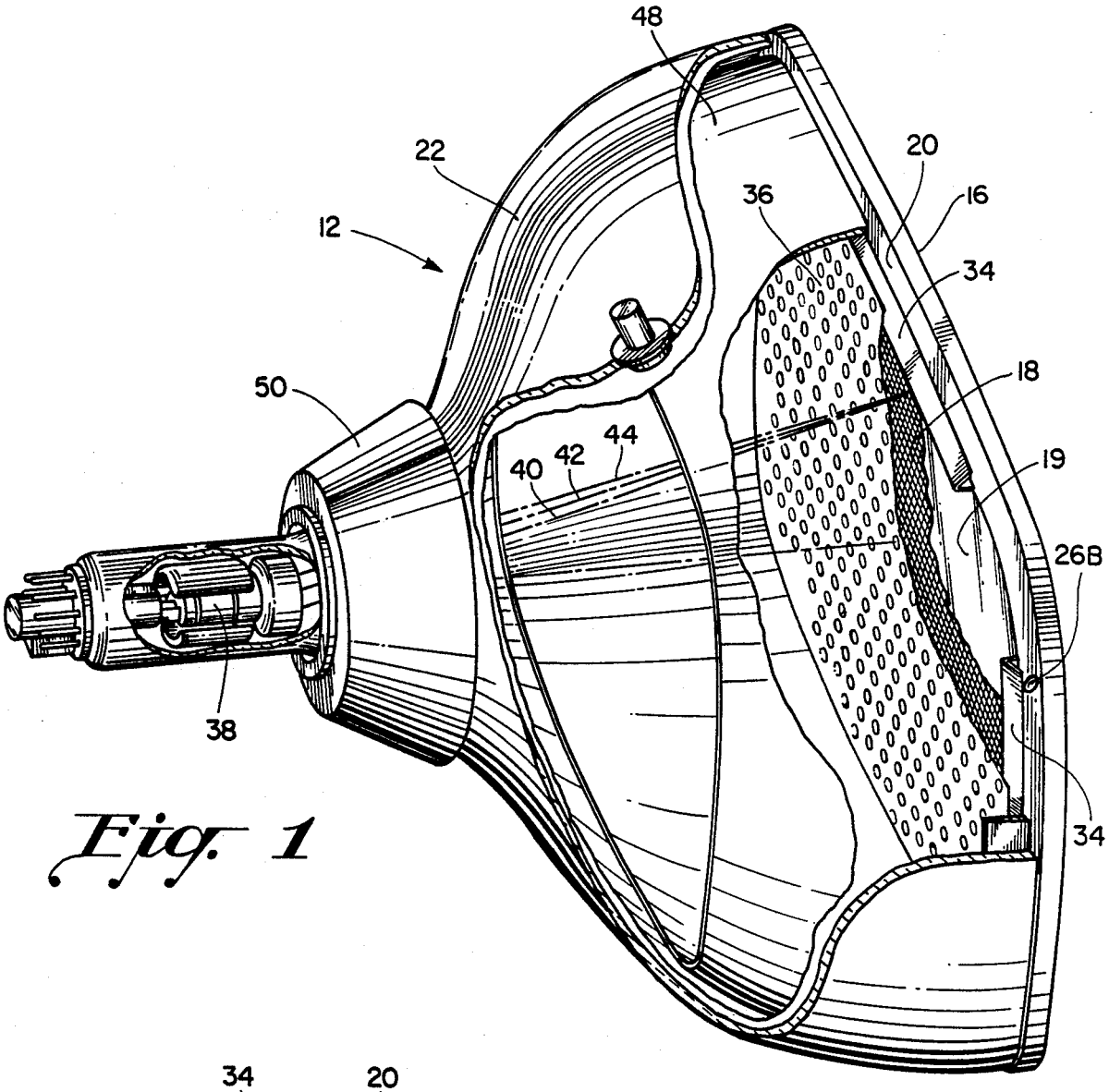
FIG. 1 is a perspective view of the partly cut away envelope of a color cathode ray tube having a front assembly with a planar shadow mask according to the invention.
Figure 2:
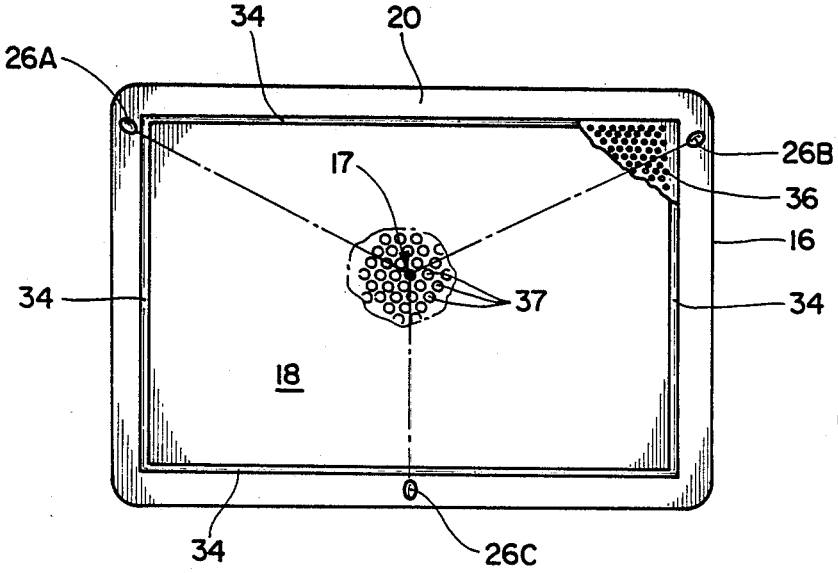
FIG. 2 is a plan view of the inner surface of the faceplate of FIG. 1 showing the relationship of the faceplate to the planar shadow mask; the inset shows a group of enlarged mask apertures located at the mask center.
Figure 3:
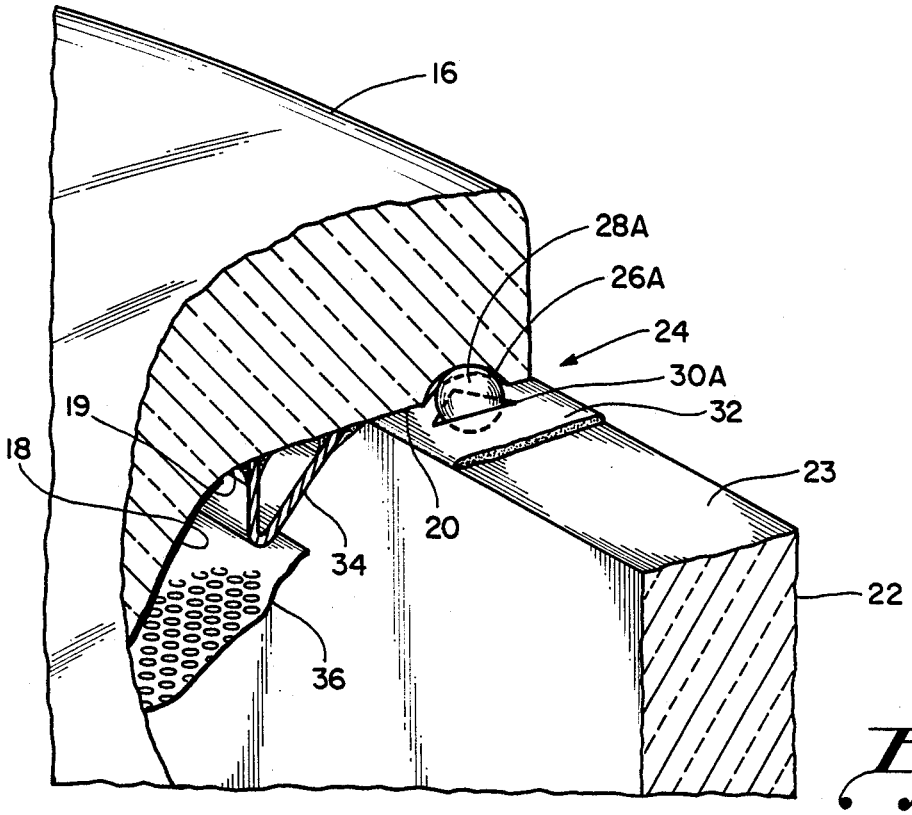
FIG. 3 is an enlarged cut-away view in perspective that shows in greater detail the relationship of the planar shadow mask according to the invention with other tube components.

(With initial reference to FIGS. 1, 2 and 3)

12—color cathode ray tube.
16—faceplate.
17—center of faceplate.
18—cathodoluminescent screen.
19—inner surface of faceplate.
20—faceplate-funnel sealing area.
22—funnel.
23—funnel-faceplate sealing area.
24—indexing means The components of the indexing means are
26A, 26B, 26C V-grooves.
28A, 28B, 28C ball means.
30A, 30B, 30C cavities.
32—layer of frit.
34—shadow mask support structure. An improved structure for supporting a planar shadow mask. The structure depicted is described and claimed in referent copending application Serial No. (5352) of common ownership herewith.
36—shadow mask. A planar tension shadow mask according to the invention.
37—mask apertures. The inset shows mask apertures, greatly enarged. Aperture diameter may be about 0.0035 inch, by way of example.
38—in-line electron gun. Provides three discrete in-line electron beams for selectively exciting the trios of phosphors deposits on the screen 18.
40, 42, 44—electron beams. For activating respective red-light-emitting, green-light emitting, and blue-light-emitting phosphor deposits on screen 18.
48—internal magnetic shield.
50—self-converging yoke. provides a measure of self-convergence of the three beams 40, 42 and 44.

Exposition of the Invention

The variation of aperture pattern in the horizontal direction according to the invention can best be understood by reference first to the ideal grouping of beam landings in relation to associated phosphor deposits at the center of the faceplate, where x and y are both equal to 0. This ideal grouping is depicted by FIGS. 4 and 4A—the beam landing areas are indicated as being perfect with relation to the associated phosphor deposits; that is, perfect in concentricity.

NOTE: For purposes of illustration only, the pattern shown by FIGS. 4, 4A, 5 and 8 represents a positive guard band relationship between the phosphor deposits and the beam landing areas. This relationship is indicated in FIGS. 4 and 4A by beam landing area 60, wherein the underlying phosphor deposit 61 is shown diagrammatically as emitting green light under the impact of the electrons. The area 63 between the boundaries of the beam landing area 60 and the phosphor deposit 61 comprises the guard band, noted as being a positive guard band for purposes of illustration. It will also be noted that the other beam landing areas depicted are also concentric with the associated phosphor deposits, indicated diagrammatically as being red-light-emitting and blue-light-emitting. The invention has been, and is preferably practiced, in a negative guard band execution (due to the increased brightness and contrast which results). It is herein illsstrated in a positive guard band execution because of the considerably greater ease in depicting (and understanding) the invention in its positive guard band execution.

Such a positive guard band execution is shown by FIG. 4 wherein a section of faceplate 16 is shown as having on its inner surface; that is, the surface facing the shadow mask, a row of phosphor deposits 56. Phosphor deposits 61, 62 and 64 are indicated graphically as emitting green, blue and red light, respectively, under the impact of three electron beamlets 66. The beamlets 66 are depicted as having passed through an aperture 68 in tensed foil shadow mask 36. (The origin of the beamlets; that is, the electron beams 40, 42 and 44 emitted by the electron gun 38 depicted in FIG. 1, is not depicted in this FIG. 4.) The beamlets 66 will be noted as being in line in accord with the beam emission of the in-line electron gun 38.

Other phosphor deposits in the same row 56 which are a part of adjacent trios of phosphor deposits, comprise green-light-emitting deposit 72, blue-light-emitting deposit 74, and a red-light-emitting deposit next in sequence (not shown) which are activated by beamlets passing through adjacent aperture 76. The horizontal pitch Pho of mask 36, and the vertical pitch Pvo of mask 36, are noted by the respective arrows.

Another row 76 of phosphor deposits is shown as being located beneath row 56. Only two of the deposits are shown: phosphor deposit 78, depicted as emitting red light, and deposit 80, depicted as emitting green light. The third member of the trio—a blue-light-emitting deposit—is not shown. The phosphors of the trio are activated by beamlets (not shown) emerging from aperture 82.

FIG. 4A is a plan view o the two rows 56 and 76 of the phosphor deposits on faceplate 16 shown by FIG. 4. P1 is the horizontal pitch of the phosphor deposits of common color emission, indicated by way of example as being green-light-emitting phosphor dpposits 61 and 72. Pitch P1/3 is indicated as being the spacing between the centers of adjacent phosphor deposits 61, 62, 64 and 72. P4 is indicated as representing the pitch of the rows of phosphor deposits in a vertical direction. The beam landings, indicated diagrammatically in FIGS. 4 and 4A by the shaded areas, will be noted as being concentric with the respective phosphor deposit; this is a condition achieved only at the center of the screen. However, with a mask having a uniform hexagonal array of apertures with constant horizontal aperture pitch, the perfect beam landings achieved at the screen center are not achieved away from the center.

The horizontal degrouping error grows parabolically with the horizontal and vertical screen position. The effect of the resultant degrouping away from the screen center in a horizontal direction is indicated by FIG. 5 for a mask not having a grouping of apertures according to the invention. Beam landing area 86 of blue-light-emitting phosphor deposit 88, energized by a "blue" beamlet, is depicted in close adjacency to beam landing area 89 of red-light-emitting phosphor deposit 90, energized by a "red" beamlet. The respective guard bands 92 and 94 will be seen as being overcome to the point where color impurities and color shading can occur. As indicated by FIG. 5, the horizontal degrouping error ("Phe") can be expressed as P2−p1/3.

The foregoing observations cnn be expressed by formula $$P2 - P\tfrac{1}{3} = \left(a\left(\frac{2x}{W}\right)^2 + b\left(\frac{2y}{H}\right)^2\right)Pho;$$

where "a" and "b" are constants. This relationship relates directly to the astigmatic aberration characteristiss of the yoke design. Constants "a" and "b" are functions of the tube size, screen aspect ratio, beam deflection angles, and the characteristics of the gun and yoke, which are an in-line gun and self-converging yoke.

In FIG. 6, the horizontal mask pitch along the horizontal axis of the mask array (i.e., y=0) is depicted by curve 98 as a function of the horizontal position (i.e., x). In FIG. 7, the horizontal mask pitch along the vertical axis of the mask array (i.e., x=0) is depicted by curve 100 as a function of the vertical position (i.e., y). FIG. 6 represents the growth of the error for the constant "a", and FIG. 7 the growth for constant "b".

FIGS. 6 and 7 depict respectively the parabolic growth of the horizontal degrouping error with vertical and horizontal screen position. In FIG. 7, the y axis represents the horizontal pitch at the degrouped beam landing areas as a function of the distance from the center of the screen, where Pho is the horizontal pitch of the beam landing areas (and phosphor deposits) in the screen center. Where the constant "b" is 0.06, for example, the horizontal pitch of the beam landing areas at the top of the screen is 1+0.06, or 1.06 times the horizontal pitch Pho at the screen center. In FIG. 6, the constant "a" may be 0.08, by way of example. As a result, the horizontal pitch of the degrouped beam landing areas as a function distance from faceplate center is 1+0.08, or 1.08 times Pho. (These relationships are further defined in conjunction with FIG. 9.) The labels on the x axis: viz., W/4, represent demarcations of the axis based on the dimensions of the mask; e.g., if the mask is 12 inches in width, W/4 would represent 3 inches (taking into account the fact that there is −W/4 as well as a +W/4).

It is notable according to the invention that the vertical degrouping error is theoretically zero for all screen positions. The fact is shown diagrammatically by FIGS. 6A and 7A wherein the growth of the vertical pitch of the beam landing areas is depicted as a function of distance from the screen center in both the horizontal direction (FIG. 6A) and the vertical direction FIG. 7A). The growth is depicted by the respective plots 102 and 104 as being non-existent, or zero, according to the invention.

With reference now to FIG. 8, it will be noted that the horizontal pitch, P6, of the mask apertures away from the mask center is changed according to the invention from a constant pitch P1 at mask center (see FIG. 4A) in such a way that the horizontal degrouping error at any point on the screen away from the mask center equals zero at all screen positions. In other words, the horizontal spacing between adjacent phosphor deposits is equal to one-third of P6 at this or any other mask position away from the center. It is also important to understand that the vertical pitch, P4, of the mask apertures according to the invention remains constant throughout the mask. The mask apertures according to the invention are characterized by having a variable horizontal pitch and a uniform, or constant, vertical pitch.

The characteristics of a variable horizontal pitch and a constant vertical pitch are illustrated in FIG. 9, which represents the upper right quadrant of shadow mask 36 according to the invention. The horizontal pitch of the apertures increases outwardly according to the invention from mask center 106 according to a function which is parabolic with horizontal displacement. The pitch Pho adjacent to the mask center 106 is depicted as increasing to 1.06 Pho at 108—the 12 o'clock edge position of the mask. At 110—the three o'clock edge position on the mask—the distance between aperture centers is 1.08 Pho, and at 112—the top right corner of the mask—the distance between aperture centers is 1.14 Pho. Further according to the invention, the horizontal pitch of the apertures is isotropic in the sense that the increase in pitch is the sum of the horizontal displacement contribution and the vertical displacement contribution. In other words, the top right corner 112 has a horizontal pitch increase equal to the sum of the 3 o'clock increase plus the 12 o'clock increase.

Moving away from the mask center 106 along a horizontal line, th mask apertures become increasingly separated horizontally, but are constant in vertical separation according to the invention. Similarly, moving away from the mask center 106 along a vertical line, the mask apertures again become increasingly separated horizontally, but are constant in vertical spacing. In both cases, the rate of increase is parabolic, but the parabolic functions are somewhat different, as described above. Moving away from mask center 106 along a diagonal line, the increasing horizontal spacing of the mask apertures represents a sum of each of the aforesaid components.

Also with reference to FIG. 9, it will be observed that by having the horizontal pitch (but not the vertical pitch) of the apertures increasing outwardly from mask center 106, the apertures define a locus of points identified by curved line 114 that indicates a pincushion distortion in the horizontal direction, but no significant distortion in the vertical direction. In effect, the variable horizontal pitch increases outwardly from the mask center 106 according to the relation $$\left(1 + a\left(\frac{2x}{W}\right)^2 + b\left(\frac{2y}{H}\right)^2\right)Pho,$$

where, as noted, the coefficients a and b are determined by such factors as the tube size, screen aspect ratio, beam deflection angles, and the characteristics of the gun and yoke, noted as being the in-line gun and the self-converging yoke; H and W are the height and width of the mask array; x and y are the horizontal and vertical locations at a point on the mask array; and Pho is the pitch of the mask in the horizontal direction at the screen center. The coefficients a and b are both in the range of from 0.02 to 0.30 according to a preferred form of the invention.

While a particular preferred embodiment of the invention has been shown and described, it will be readily apparent to those skilled in the art that changes and modifications may be made in the inventive means without departing from the invention in its broader aspects, and therefore, the aim of the appended claims is to cover all such changes and modifications as fall within the true spirit and scope of the invention.

We claim:

1. For use in a color cathode ray tube having a substantially flat faceplate, a planar shadow mask with a pattern of circular apertures characterized by having a substantially constant vertical pitch throughout the mask, but with a horizontal pitch increasing outwardly from the center of the mask.

2. For use in a color cathode ray tube having a substantially flat faceplate, a planar shadow mask having a pattern of circular apertures characterized by having a constant vertical pitch, but with a horizontal pitch increasing outwardly from the center of the mask such that said apertures define loci of points having a pincushion distortion in the horizontal direction, but no significant distortion in the vertical direction.

3. For use in a color cathode ray tube with a substantially flat faceplate, a flat tension mask with an aperture pattern characterized by having a constant vertical pitch, but with a horizontal pitch increasing outwardly from the center of the mask according to a function which is parabolic with horizontal position and parabolic with vertical position.

4. For use in a color cathode ray tube with a substantialy flat faceplate, an in-line electron gun and a self-converging yoke, a flat tension mask characterized by having a mask array of apertures having a horizontal pitch which increases outwardly form the center of the mask according to the relation $$1 + a\frac{2x}{W} + b\frac{2y}{H}\ Pho,$$

wherein the coefficients a and b are determined by such factors as tube size, screen aspect ratio, beam deflection angles, and the characteristics of the in-line electron gun and the self-converging yoke; H and W are the height and width of the mask array; x and y are the horizontal and vertical locations at a point on the mask array; and Pho is the horizontal pitch of the apertures at the center of the mask.

5. The color cathode ray tube according to claim 4 wherein the mask array of apertures has a constant vertical pitch, and wherein the coefficients a and b are both in the range of 0.02 to 0.30.

6. For use in a color cathode ray tube having a self-converging yoke and an in-line electron gun, a front assembly comprising a substantially flat faceplate and an associated planar shadow mask in spaced adjacency thereto having an aperture pattern characterized by having a horizontal pitch which increases outwardly from the center of the mask.

7. For use in a color cathode ray tube having a self-converging yoke and an in-line electron gun, a front assembly comprising a substantially flat faceplate and an associated planar shadow mask in spaced adjacency thereto, said mask having an aperture pattern characterized by having a constant vertical pitch throughout the mask, but with a horizontal pitch increasing outwardly form the center of the mask.

8. For use in a color cathode ray tube having a self-converging yoke and an in-line electron gun, a front assembly comprising a substantially flat faceplate and an associated planar shadow mask in spaced adjacency thereto, said mask having an aperture pattern characterized by having a horizontal pitch increasing outwardly from the center of the mask such that said apertures define loci of points having a pincushion distortion in the horizontal direction, but no significant distortion in the vertical direction.

9. For use in a color cathode ray tube having a self-converging yoke and an in-line electron gun, a front assembly comprising a substantially flat faceplate and an associated planar shadow mask in spaced adjacency thereto, said mask having an aperture pattern characterized by having a constant vertical pitch, but with a horizontal pitch increasing outwardly from the center of the mask according to a function which is parabolic with horizontal position and parabolic with vertical position.

10. For use in a color cathode ray tube having a self-converging yoke and an in-line electron gun, a front assembly comprising a substantially flat faceplate and an associated planar shadow mask in spaced adjacency thereto, said mask having a mask array of apertures and said mask array of apertures having a vertical pitch and a horizontal pitch which increases outwardly from the center of the mask according to the relation $$1 + a\frac{2x}{W} + b\frac{2y}{H}\ Pho,$$

wherein the coefficients a and b are determined by such factors as the tube size, screen aspect ratio, beam deflection angles, and the characteristics of the in-line electron gun and self-converging yoke; H and W are the height and width of the mask array; x and y are the horizontal and vertical locations at a point on the mask array; and Pho is the horizontal pitch of the apertures at the center of the mask.

11. The color cathode ray tube according to claim 10 wherein the vertical pitch of the mask apertures is constant throughout the mask, and wherein the coefficients a and b are both in the range of 0.02 to 0.30.

12. For use in a color cathode ray tube having an in-line electron gun, a front assembly comprising a substantially flat faceplate supporting a pattern of phosphor deposits and an associated planar shadow mask in spaced parallel adjacency thereto having a related pattern of apertures, the apertures in said pattern of apertures and the deposits in said pattern of phosphor deposits each having a horizontal pitch which increases outwardly form its respective pattern center, while having a vertical pitch in each case remaining constant throughout its respective pattern.

13. For use in a color cathode ray tube having an in-line electron gun, a front assembly comprising a substantially flat faceplate supporting a pattern of circular phosphor deposits and an associated planar shadow mask in spaced parallel adjacency thereto having a related pattern of circular apertures, the apertures in said pattern of apertures and the deposits in said pattern of phosphor deposits each having a horizontal pitch which increases outwardly from its respective pattern center, while having a vertical pitch in each case remaining substantially constant throughout its respective pattern.

14. For use in a color cathode ray tube having an in-line electron gun and a self converging yoke, a front assembly comprising a substantially flat faceplate supporting a pattern of circular phosphor deposits and an associated planar shadow mask and spaced parallel adjacency thereto having a mask array with a related pattern of circular apertures, the apertures in said pattern of apertures and the deposits in said pattern of phosphor deposits each having a horizontal pitch which increases outwardly from its respective pattern center, according to a function which is parabolic with horizontal position and parabolic with vertical position.

15. The color cathode ray tube according to claim 14 wherein said horizontal pitch of said apertures and said deposits increases outwardly from the center of the mask according to the relation $$1 + a\left(\frac{2x}{W}\right)^2 + b\left(\frac{2y}{H}\right)^2 Pho,$$

wherein the coefficients a and b are determined by such factors as the tube size, screen aspect ratio, beam deflection angles, and the characteristics of the in-line electron gun and self-converging yoke; H and W are the height and width of the mask array; and x and y are the horizontal and vertical locations at a point on the mask array; and Pho is the horizontal pitch of the apertures at the center of the mask.

16. The color cathode ray tube according to claim 15 wherein the vertical pitch of the mask apertures is constant throughout the mask, and wherein the coefficients a and b are both in the range of 0.02 to 0.30.

* * * * *